US009228429B2

(12) United States Patent
DiFoggio et al.

(10) Patent No.: US 9,228,429 B2
(45) Date of Patent: Jan. 5, 2016

(54) CARBON DIOXIDE CONTENT OF NATURAL GAS FROM OTHER PHYSICAL PROPERTIES

(71) Applicants: Rocco DiFoggio, Houston, TX (US); Juan Carlos Flores, Kuala Belait (BN)

(72) Inventors: Rocco DiFoggio, Houston, TX (US); Juan Carlos Flores, Kuala Belait (BN)

(73) Assignee: Baker Hughes Incorporated, Houston, TX (US)

( * ) Notice: Subject to any disclaimer, the term of this patent is extended or adjusted under 35 U.S.C. 154(b) by 397 days.

(21) Appl. No.: 13/727,089

(22) Filed: Dec. 26, 2012

(65) Prior Publication Data

US 2013/0180710 A1 Jul. 18, 2013

Related U.S. Application Data

(60) Provisional application No. 61/587,954, filed on Jan. 18, 2012.

(51) Int. Cl.

| | |
|---|---|
| ***E21B 49/08*** | (2006.01) |
| ***E21B 47/06*** | (2012.01) |
| ***E21B 47/10*** | (2012.01) |

(52) U.S. Cl.

CPC ..... *E21B 47/065* (2013.01); *E21B 47/06* (2013.01); *E21B 47/1005* (2013.01)

(58) Field of Classification Search

CPC ..... E21B 49/08; G01N 33/24; G01V 9/00

USPC ..... 166/250.01, 66; 73/152.18, 152.31, 73/152.42, 152.45; 436/29; 702/13, 23, 702/24, 30

See application file for complete search history.

(56) References Cited

U.S. PATENT DOCUMENTS

| | | | | |
|---|---|---|---|---|
| 6,209,387 | B1 * | 4/2001 | Savidge | G01F 1/66 73/23.29 |
| 6,218,662 | B1 | 4/2001 | Tchakarov et al. | |
| 6,604,051 | B1 * | 8/2003 | Morrow | G01N 29/024 702/24 |
| 6,627,873 | B2 * | 9/2003 | Tchakarov et al. | 250/256 |
| 7,027,928 | B2 | 4/2006 | DiFoggio | |
| 7,210,332 | B2 | 5/2007 | Kolosov et | |
| 7,398,160 | B2 * | 7/2008 | Morrow | G01N 29/07 702/24 |
| 7,526,953 | B2 * | 5/2009 | Goodwin et al. | 73/152.28 |
| 8,032,303 | B2 | 10/2011 | Fujisawa et al. | |
| 2005/0205256 | A1 * | 9/2005 | DiFoggio | 166/250.16 |
| 2005/0269499 | A1 * | 12/2005 | Jones et al. | 250/269.1 |
| 2006/0032301 | A1 * | 2/2006 | DiFoggio | 73/152.18 |
| 2006/0243047 | A1 | 11/2006 | Terabayashi et al. | |

(Continued)

OTHER PUBLICATIONS

Peng et al., "A New Two-Constant Equation of State", Ind. Eng. Chem., Fundam, vol. 5, No. 1, 1976, pp. 59-64.

(Continued)

*Primary Examiner* — Kenneth L Thompson

(74) *Attorney, Agent, or Firm* — Cantor Colburn LLP

(57) ABSTRACT

An apparatus and method are described to estimate a fraction of carbon dioxide present in a downhole fluid. The apparatus includes a carrier configured to be conveyed through a borehole penetrating the earth. The apparatus also includes a pressure sensor disposed at the carrier and configured to measure an ambient pressure of the downhole fluid and an ambient temperature sensor disposed at the carrier and configured to measure a temperature of the downhole fluid. A processor of the apparatus receives the ambient pressure and the ambient temperature measurements and solves for the fraction of carbon dioxide in the downhole fluid using a correlation function with the ambient pressure and the ambient temperature as inputs to the correlation function.

15 Claims, 5 Drawing Sheets

(56) References Cited

U.S. PATENT DOCUMENTS

| | | | | |
|---|---|---|---|---|
| 2008/0141767 | A1* | 6/2008 | Raghuraman et al. | 73/152.55 |
| 2010/0332138 | A1 | 12/2010 | Inanc et al. | |
| 2011/0088895 | A1* | 4/2011 | Pop et al. | 166/254.2 |
| 2011/0088949 | A1* | 4/2011 | Zuo | E21B 49/10 175/48 |
| 2013/0036811 | A1* | 2/2013 | Boult | 73/152.27 |
| 2013/0289961 | A1* | 10/2013 | Ray | E21B 47/00 703/10 |

OTHER PUBLICATIONS

Post, Scott, "Equations of State", ME501 Advanced Thermodynamics, Fall 2009, pp. 1-8.

International Search Report and Written Opinion for PCT Application No. PCT/US2013/021648, dated Apr. 29, 2013, pp. 1-8.

* cited by examiner

CARBON DIOXIDE CONTENT OF NATURAL GAS FROM OTHER PHYSICAL PROPERTIES

CROSS-REFERENCE TO RELATED APPLICATION

This application is a Non-Provisional application of U.S. Provisional Patent Application No. 61/587,954, filed Jan. 18, 2012, the disclosure of which is incorporated by reference herein in its entirety.

BACKGROUND OF THE INVENTION

Natural gas, when recovered from a well, typically includes a mixture of gases and also includes carbon dioxide. For example, natural gas may include mole percentages of approximately 85% for methane, approximately 5% ethane, approximately 2% propane, and smaller percentages of other gases. The carbon dioxide component can affect the drilling, production and processing operations related to the recovery of natural gas. For example, the carbon dioxide can affect the quality of the drilling fluid. In addition, the carbon dioxide has to be removed during processing before it can be transported in a pipeline to customers. The cost of removing the carbon dioxide plus the cost of sequestering it can affect the economics of a well. Hence, it would be appreciated in the drilling industry if an amount of carbon dioxide in natural gas could be quickly and accurately determined.

BRIEF SUMMARY

According to one aspect of the invention, an apparatus for estimating a fraction of carbon dioxide present in a downhole fluid includes a carrier configured to be conveyed through a borehole penetrating the earth; a pressure sensor disposed at the carrier and configured to measure an ambient pressure of the downhole fluid; an ambient temperature sensor disposed at the carrier and configured to measure a temperature of the downhole fluid; and a processor configured to receive the ambient pressure and the ambient temperature measurements and solve for the fraction of carbon dioxide in the downhole fluid using a correlation function with the ambient pressure and the ambient temperature as inputs to the correlation function.

According to another aspect of the invention, a method for estimating a fraction of carbon dioxide present in a downhole fluid includes conveying a carrier through a borehole penetrating an earth formation containing the downhole fluid; measuring an ambient pressure of the downhole fluid using a pressure sensor disposed at the carrier; measuring an ambient temperature of the downhole fluid using a temperature sensor disposed at the carrier; and estimating the fraction of carbon dioxide in the downhole fluid by using a correlation function with the ambient pressure and the ambient temperature as inputs.

According to yet another aspect of the invention, a non-transitory computer readable medium comprises computer executable instructions for estimating a fraction of carbon dioxide present in a fluid downhole by implementing a method that includes receiving a measurement of an ambient pressure of the downhole fluid performed by a pressure sensor disposed at a carrier configured to be conveyed through a borehole penetrating an earth formation; receiving a measurement of an ambient temperature of the downhole fluid performed by a temperature sensor disposed at the carrier; and estimating the fraction of carbon dioxide in the downhole fluid by using a correlation function with the ambient pressure and the ambient temperature as inputs.

BRIEF DESCRIPTION OF THE DRAWINGS

Referring now to the drawings wherein like elements are numbered alike in the several Figures.

DETAILED DESCRIPTION

Figure 1:
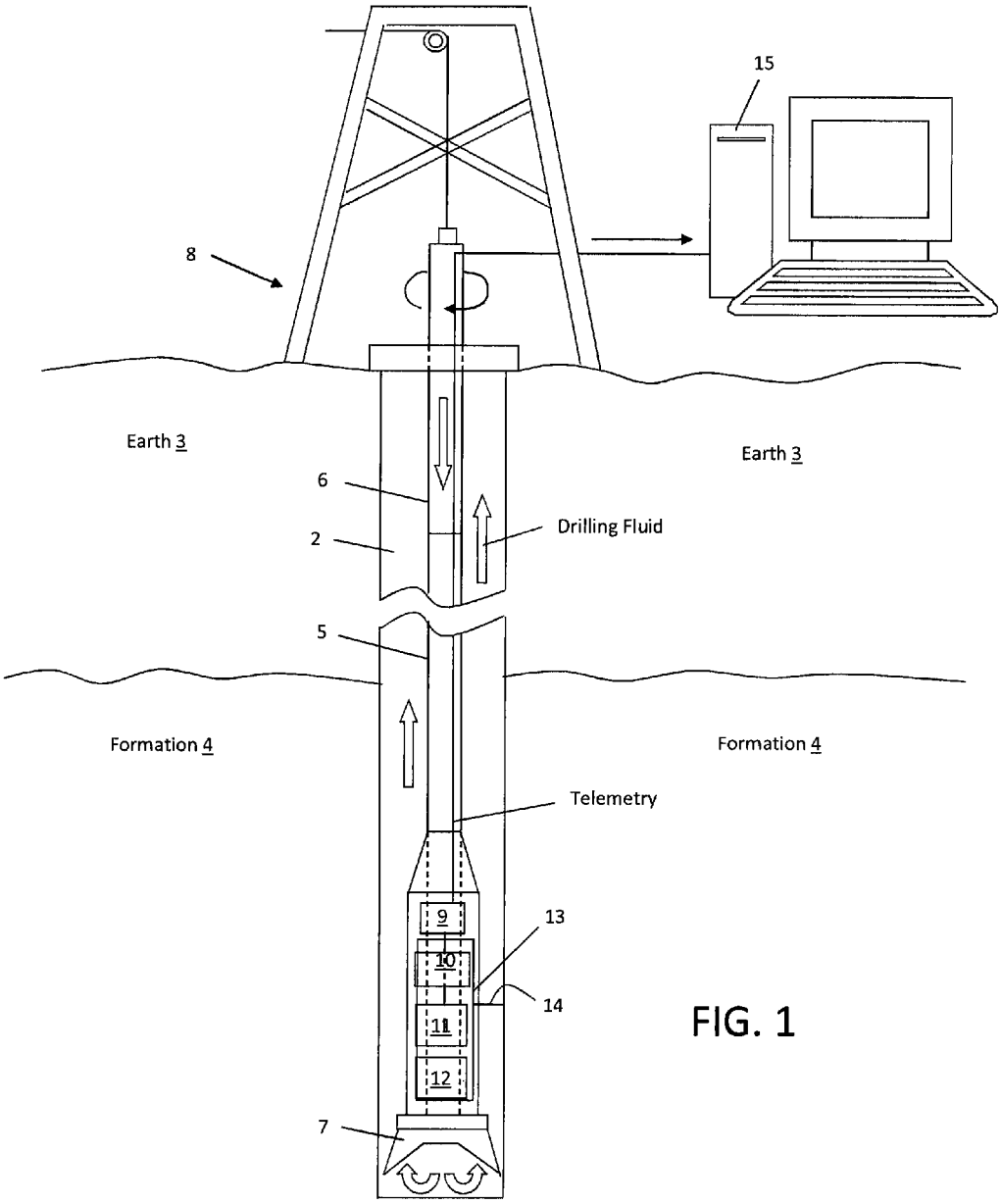
FIG. 1 illustrates a cross-sectional view of an exemplary embodiment of an apparatus for estimating a fraction of carbon dioxide in downhole fluid.

FIG. 1 illustrates a cross-sectional view of an exemplary embodiment of an apparatus for estimating a fraction of carbon dioxide in a downhole fluid. A bottom hole assembly (BHA) 15 is disposed in a borehole 2 penetrating the earth 3, which includes an earth formation 4. The formation 4 represents any subsurface material of interest. The BHA 15 is conveyed through the borehole 2 by a carrier 5. In the embodiment of FIG. 1, the carrier 5 is a drill string 6 in an embodiment known as logging-while-drilling (LWD). In an alternative embodiment, the carrier 5 can be an armored wireline in an embodiment known as wireline logging. Disposed at a distal end of the drill string 6 is a drill bit 7. A drilling rig 8 is configured to conduct drilling operations such as rotating the drill string 6 and thus the drill bit 7 in order to drill the borehole 2. In addition, the drilling rig 8 is configured to pump drilling fluid through the drill string 6 in order to lubricate the drill bit 7 and flush cuttings from the borehole 2.

The BHA 15 includes a formation tester 13 configured to extract a sample of the downhole fluid from the formation 4. In order to extract the sample, the formation tester 13 includes a probe 14 configured to extend from the formation tester 13 and seal to a wall of the borehole 2. The formation tester 13 is configured to decrease the pressure within the probe 14 causing the downhole fluid to flow from the formation 4 into the formation tester 13. A pressure sensor 10, a density sensor 11, and a temperature sensor 12 are configured to sense the pressure, density, and temperature of the sample, respectively. Downhole electronics 9 are configured to operate the formation tester 13 and the sensors 10, 11 and 12, process data, and/or act as a communications interface. Telemetry is used to provide communications between the formation tester 13 and a computer processing system 16 disposed at the surface of the earth 3. In an alternate embodiment, sensor data processing or operations can also be performed by the computer processing system 16 in addition to or in lieu of the downhole electronics 9. In general, the formation tester 13 extracts a sample and performs sample measurements at selected depths or intervals downhole during a temporary halt in drilling.

In order to determine the fraction of carbon dioxide in a downhole fluid mixture containing carbon dioxide, a density determination of the total mixture is performed as well as measuring the pressure and temperature of mixture. The fraction of carbon dioxide is then estimated by using an extremely complicated empirical function of density, pressure, and temperature. The density of the fluid mixture can be determined using several techniques. In the first technique, the density is determined by using a pressure gradient of the downhole fluid mixture of interest. The pressure gradient and corresponding density of fluid in a subterranean zone is determined downhole by the rate of change of pressure with true vertical depth over that zone. A column of fluid such as the formation 4 column may have a natural gas layer (with very little pressure gradient) floating above an oil layer (with a higher pressure gradient) floating above a water layer (with the highest pressure gradient). Hence, for a mixture of natural gas and carbon dioxide, a pressure gradient within that layer may be used to determine the density of the mixture. Density is then determined from the pressure gradient (rate of change of pressure with true vertical depth, which is density*g) by the downhole electronics 9 or the computer processing system 16 based on:

density*$g$*$h$=change in fluid pressure with change, $h$, in true vertical depth [EQ 1]

where g=gravitational force; and h=height of the column (without any impermeable zones within h).

density*g=pressure gradient so density is pressure gradient/g.

Pressure measurements of the downhole fluid mixture at at least two depths or heights within the borehole 2 may be performed by the pressure sensor 10 or by other pressure sensors. The at least two depths or heights are separated by true vertical depth. In an embodiment where the borehole is deviated from vertical, true vertical depth is the vertical component of separation between the pressure measurements. While density can be determined from the pressure gradient, as discussed above, an optional density sensor 11 (FIG. 2) may be used to determine density according to another embodiment.

Figure 2:
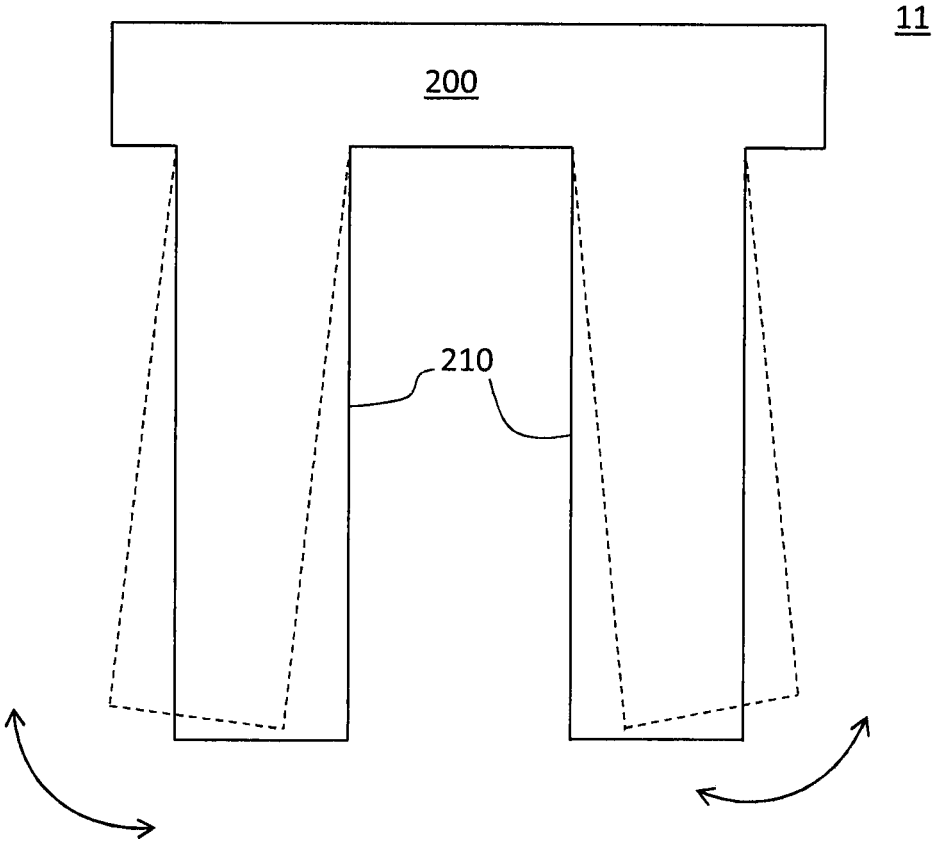
FIG. 2 depicts a flexural mechanical resonator according to an embodiment of the invention.

In another technique, the density of the fluid mixture is measured using the density sensor 11. In one or more embodiments, the density sensor 11 is a flexural mechanical resonator (FRM) 20 as illustrated in FIG. 2. At least a portion of the FRM 20 is immersed in a fluid of interest. The immersed portion of the FRM 20 is configured to vibrate or resonate in the fluid of interest in order to directly measure the fluid density. In the embodiment of FIG. 2, the FRM 20 is made of a piezoelectric material and shaped as a tuning fork. Two electrodes 25 are disposed in each tine of the tuning fork. When an alternating voltage is applied to the electrodes 25, the immersed portion will vibrate or resonate with a characteristic related to the density of the fluid of interest. The motion of the tines in the fluid of interest creates an electrical motion impedance that can be measured and related to the fluid density either by analysis or calibration in reference fluids. Other types of density sensors can also be used.

For miscible fluids, the density of the total fluid mixture can be expressed as a function of the densities and volume fractions of the constituent components making up the total fluid mixture:

density ($d$) of fluid mixture=function($d1$,$f1$;$d2$,$f2$;$d3$, $f3$; . . . ) where $d1$, $f1$, $d2$, $f2$, $d3$, $f3$, . . . are densities ($d$) and fractions ($f$) of constituents 1, 2, 3, . . . making up the fluid mixture [EQ 2]

Empirical equations are developed for the fraction of CO2 in mixtures of carbon dioxide and natural gas at the downhole pressure and temperature for one or more typical natural gases. The density of the CO2 natural gas mixture varies in a very complex nonlinear way with pressure, temperature, and composition so inverting the equation-of-state density equation is not possible algebraically. Thus, an empirical approach, discussed below, is taken instead.

An exemplary approach to determining the fraction of carbon dioxide in the total fluid mixture involves developing a chemometric model as detailed further below. The natural gas in this exemplary case has constituent mole fractions corresponding to an average of 97 wells from around the world, as shown in Table 1:

TABLE 1

Average of 97 Gas Wells Worldwide

| Mole % | Gas |
|---|---|
| 84.33 | C1-Methane-Molecular Weight = 16 |
| 4.65 | C2-Ethane-MW = 30 |
| 2.26 | C3-Propane-MW = 44 |
| 1.37 | C4-Butane-MW = 58 |
| 0.77 | C5-Pentane-MW = 72 |
| 0.60 | C6-Hexane-MW = 86 |
| 4.36 | C7+ having Avg. MW = 160.6 closest to C11 |
| 0.49 | N2 |
| 1.15 | CO2 |
| 0.01 | H2S |

The process described below could be repeated using a natural gas that is lighter (more methane relative to heavier hydrocarbons) or denser (less methane relative to heavier hydrocarbons) than the average natural gas to generate equations that are even more accurate for fraction of CO2 in these lighter or heavier gases. In the exemplary approach, synthetic data samples are generated, whose density values are calculated for various pressure values, temperature values, and mole fraction mixes by using an equation of state model. These synthetic data samples are then used as a training set to empirically invert the density equation (an equation whose inputs are fraction of CO2, the fractions of various hydrocarbons and of nitrogen in the average natural gas, and the temperature and pressure, and whose output is density) to instead solve for CO2 mole fraction (an equation whose output is mole fraction of CO2 and whose inputs are density, temperature and pressure), and this empirical inversion of the equation of state is optimized (i.e., a correlation function is developed as a chemometric model) to allow an estimation of the fraction of carbon dioxide based on pressure, temperature, and density.

Obtaining the data samples of density values, in one embodiment, includes using the Peng-Robinson equation of state and the corresponding computer program available from the National Institute of Standards and Technology (NIST). The Peng-Robinson equation of state programs predicts thermodynamic and transport properties of pure fluids and fluid mixtures containing up to 20 components. The components are selected from a database of at least 196 components, mostly hydrocarbons. Thus, the Peng-Robinson equation program outputs the density of the total fluid mixture once the pressure, temperature, and mole fraction values are entered. An exemplary sample data set includes 30 000 density values resulting from 1 500 combinations of temperature and pressure for a given mole fraction of fluid mix (different percentages of carbon dioxide and each of the constituent gases). That is, for a given fluid mix, the pressure is held constant for a range of temperature values and the density is computed for each temperature value in the range, and then the temperature is held constant for a range of pressure values, and the density is computed for each value in the range. Specifically, about 1,500 of the 30,000 samples are calculated for 100% carbon dioxide (no natural gas in the mix), about 1,500 of the 30,000 samples are calculated for 100% natural gas (no carbon dioxide in the mix), and 27,000 samples are calculated for different mixtures of carbon dioxide and natural gas in between (e.g., by changing the fraction of carbon dioxide by 5% for each set of samples and keeping the proportions of constituent gases in the natural gas the same). Thus, for each of the total of 30,000 different mixes, the procedure described above (computing density for a pressure and range of temperature values and for a temperature and a range of pressure values) is repeated to obtain the synthetic samples.

Once all the density samples are obtained, the process includes inverting the Peng-Robinson equation so that the fraction of carbon dioxide can be determined based on pressure, temperature, and density alone. The fact that the relationship between density and mole fraction for a given pressure and temperature is non-linear contributes to the complexity of this part of the process and requires empirically, rather than algebraically, solving for the fraction of carbon dioxide in a mixture with natural gas because it is not mathematically possible to algebraically solve such equations. The exemplary embodiment uses the commercially available computer program STATISTICA, which performs a step forward multiple linear regression with substitution. As the name implies, multiple regression means that any number of predictor variables (X variables) may be used to do regression analysis with fraction of carbon dioxide as the Y variable. To start the process, the predictor variables are pressure, temperature, and density, and powers, roots, inverses, logarithms, and various cross products or ratios of the preceding. After trial and error, educated guesses for new potential predictor variables are generated. For example, a first correlation formula is developed through STATISTICA using the approximately 1,500 of the 30,000 synthetic samples relating to 100% carbon dioxide and using, as exemplary X variables, pressure, pressure/absolute temperature, square of pressure, the base 10 logarithm of pressure and of absolute temperature, and square of absolute temperature. This first correlation formula gives the base 10 logarithm of 100% carbon dioxide density. A second correlation formula is developed through STATISTICA using approximately 1,500 of the 30,000 synthetic samples relating to 100% natural gas (i.e., the 97 well average shown in Table 1) and using the similar exemplary X variables as in the first correlation formula. This second correlation formula gives the base 10 logarithm of 100% natural gas density.

These two correlation equations represent the two extremes (highest density of carbon dioxide and lowest density of carbon dioxide) in a mixture, such that using these 100% endpoint density equations improves the correlation to fractions of CO2 in mixtures. Outputs of the two correlation formulas are used to provide additional predictor variables (X variables) in the development of the correlation formula (in STASTISTICA) to provide the fraction of carbon dioxide in a mixed fluid (not purely carbon dioxide or natural gas) of 27,000 samples. The remaining predictor variables (inputs to the resulting correlation function) are functions of pressure, density, and temperature as measured or determined as discussed above. The development of the correlation function could be done by the downhole electronics 9 or the computer processing system 16 or a combination of the two or may be done a priori such that the downhole electronics 9 or the computer processing system 16 or a combination of the two only applies the correlation function to pressure, temperature, and density values to estimate the fraction of carbon dioxide on site.

Figure 3A:
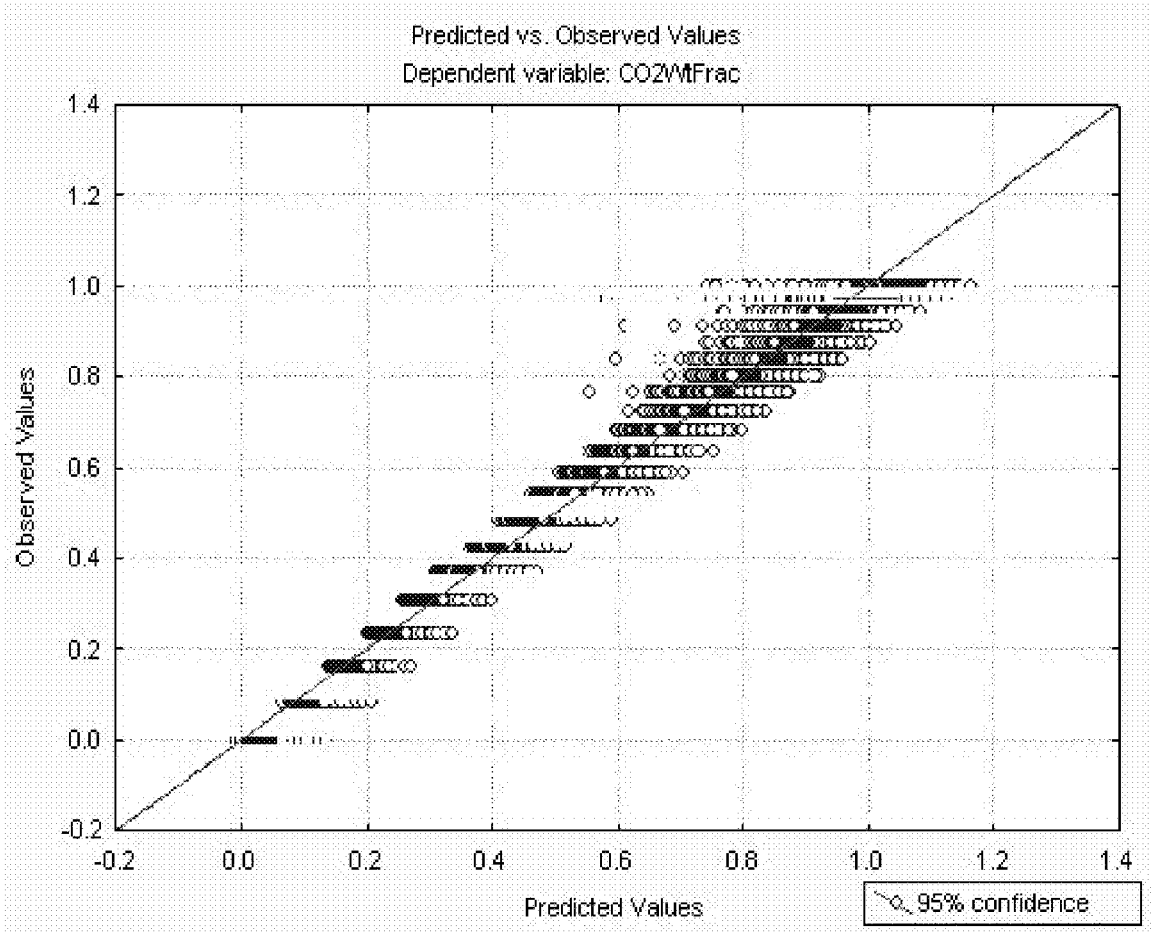
FIGS. 3*a* and 3*b* (collectively referred to as FIG. 3) illustrate the fit of two different correlation functions according to an embodiment of the invention.
Figure 3B:
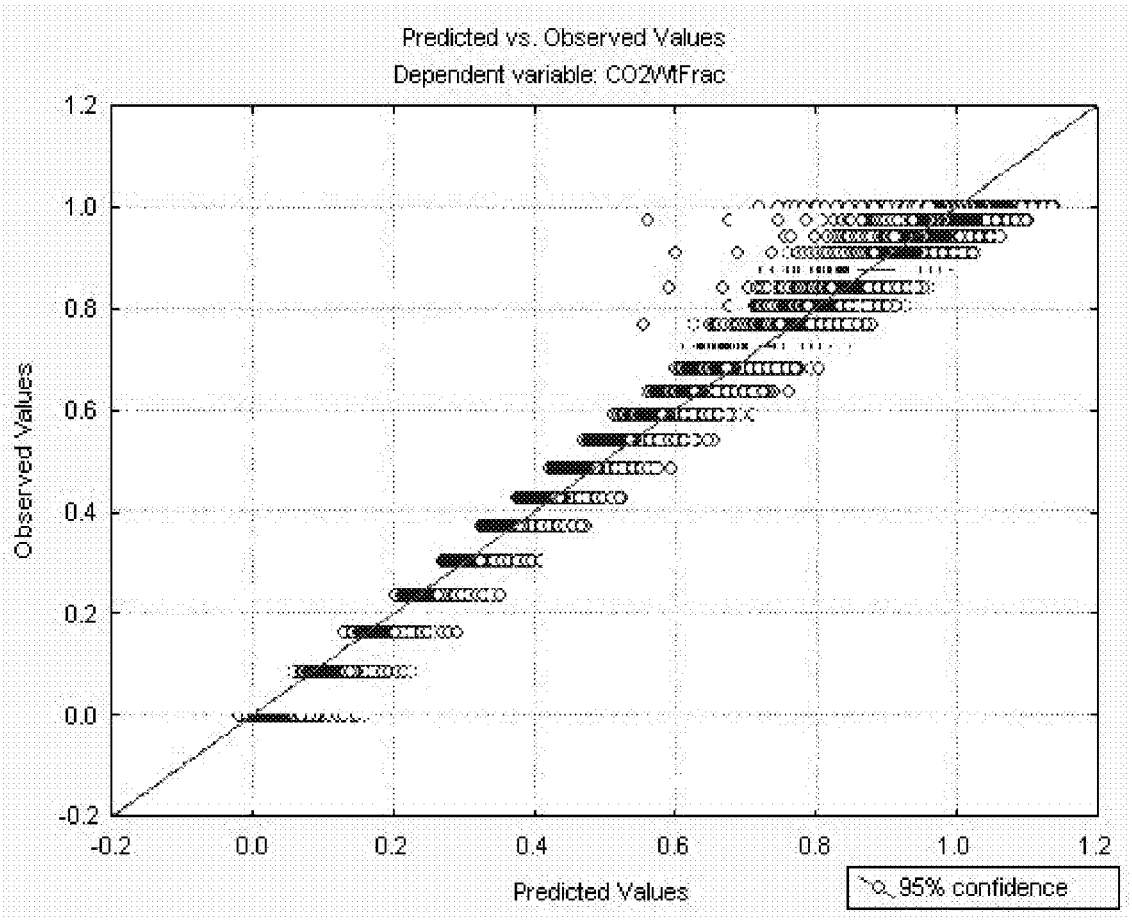

FIGS. 3*a* and 3*b* illustrate the fit of two different correlation functions according to an embodiment of the invention. The two different correlation functions (chemometric models) are developed using different predictor variables (different functions of density, pressure and temperature) for the same mix of carbon dioxide and natural gas. The majority of the predicted values (circles) fall along the line of confidence (where the predicted and observed values are equal), thereby indicating a good fit between the true value of the fraction of carbon dioxide in the mix and the predicted value based on either one of the chemometric models. However, because there are 30,000 points, and most of the points lie indistinguishably on top of one another very close to the equal value line, this plot appears visually to have a lot more scatter of data points than is actually the case.

Figure 4:
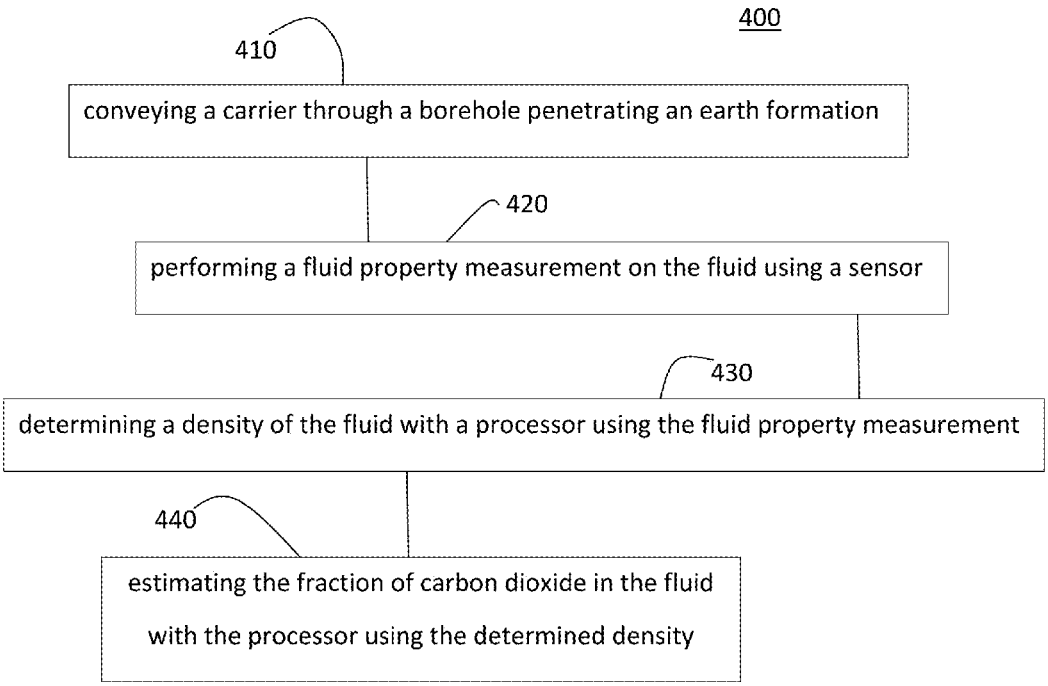
FIG. 4 illustrates the processes involved in estimating a fraction of carbon dioxide in downhole fluid based on an embodiment of the invention.

FIG. 4 illustrates the processes 400 involved in estimating a fraction of carbon dioxide in a downhole fluid based on an embodiment of the invention. Block 410 involves conveying a carrier 5 through the borehole 2 penetrating an earth formation 4. The process of block 410 can include the carrier 5 conveying the BHA 12 through the borehole 2. Block 420 involves performing an ambient pressure measurement of the downhole fluid of interest using the pressure sensor 10 in order to accurately determine the density of fluid mixture constituents. In one embodiment, the sensor 10 also measures ambient pressure at another location in a layer containing the downhole fluid of interest in order to measure a pressure gradient used to determine the density of the total fluid mixture. Block 430 involves performing a temperature measurement of the total fluid mixture using the temperature sensor 12 in order to accurately determine the density of fluid mixture constituents. Block 440 involves performing a density measurement of the total fluid mixture using the density sensor 11. Alternatively, the ambient pressure measurements performed in block 420 (at various borehole 2 depths) can be used to measure the pressure gradient for determining the density of the total fluid mixture. Block 450 involves developing a chemometric model to determine the fraction of carbon dioxide in the fluid mixture based on the pressure, temperature, and density. This process involves inverting an expression that gives density based on pressure, temperature, and mole fractions of the constituents of a fluid mixture, as discussed above. Block 460 involves using the chemometric model to solve for the fraction of carbon dioxide.

The teachings discussed above provide several advantages. It can be appreciated that at a field location the constituent components of natural gas may not be known. Hence, an approximation of the fraction of carbon dioxide can be estimated with sufficient accuracy to determine if a natural gas well will be economically feasible. Carbon dioxide does not burn like hydrocarbon fuel and it cannot simply be released into the atmosphere (it's a greenhouse gas) so disposal of the CO2 adds cost and reduces the value of any natural gas containing substantial amounts of it. Also, CO2 is corrosive so knowing how much of it is present helps in designing the production string tubulars and deciding whether to make these tubulars out of corrosion resistant metals. The corrosion resistant tubulars are much more expensive than standard production tubulars. In addition, in some situations, existing downhole equipment can provide the necessary data to estimate the fraction of carbon dioxide in the formation of interest.

In support of the teachings herein, various analysis components may be used, including a digital and/or an analog system. For example, the downhole electronics 9 or the computer processing system 16 may include the digital and/or analog system. Each system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art.

It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for estimating a fraction of carbon dioxide present in a downhole fluid, the apparatus comprising:

a carrier configured to be conveyed through a borehole penetrating the earth;

a pressure sensor disposed at the carrier and configured to measure an ambient pressure of the downhole fluid;

a temperature sensor disposed at the carrier and configured to measure an ambient temperature of the downhole fluid; and a processor configured to receive the ambient pressure and the ambient temperature measurements and solve for the fraction of carbon dioxide in the downhole fluid using a correlation function with the ambient pressure and the ambient temperature as inputs to the correlation function.

2. The apparatus according to claim 1, wherein the correlation function is derived empirically from a training data set of density values by inverting a formula that provides each of the density values based on a temperature input, a pressure input, and a mole fraction input for every constituent in a fluid mix.

3. The apparatus according to claim 1, wherein the processor is further configured to input density to the correlation function.

4. The apparatus according to claim 3, wherein the processor is further configured to receive another ambient pressure measurement of the downhole fluid at another location in the borehole, and the processor determines the density based on a pressure gradient between the ambient pressure and the another ambient pressure.

5. The apparatus according to claim 3, further comprising a fluid density sensor configured to measure the density.

6. The apparatus according to claim 5, wherein the fluid density sensor comprises a piezoelectric material shaped as a tuning fork and having two electrodes disposed therein.

7. The apparatus according to claim 1, wherein functions of the ambient pressure and the ambient temperature are used as inputs to the correlation function.

8. A method for estimating a fraction of carbon dioxide present in a downhole fluid, the method comprising:

conveying a carrier through a borehole penetrating an earth formation containing the downhole fluid;

measuring an ambient pressure of the downhole fluid using a pressure sensor disposed at the carrier;

measuring an ambient temperature of the downhole fluid using a temperature sensor disposed at the carrier; and estimating the fraction of carbon dioxide in the downhole fluid by using a correlation function with the ambient pressure and the ambient temperature as inputs.

9. The method according to claim 8, further comprising:

deriving the correlation function empirically from a training data set of density values of the downhole fluid by inverting a formula that provides each of the downhole fluid density values based on a temperature input, a pressure input, and a mole fraction input for every constituent in a fluid mix.

10. The method according to claim 8, wherein the estimating the fraction of carbon dioxide includes using functions of the ambient pressure and the ambient temperature and density of the downhole fluid as inputs to the correlation function.

11. The method according to claim 8, further comprising determining the density of the downhole fluid using the ambient pressure.

12. The method according to claim 11, further comprising performing another ambient pressure measurement of the downhole fluid and determining the density of the downhole fluid from a pressure gradient between the ambient pressure and the another ambient pressure.

13. The method according to claim 8, further comprising measuring the density of the downhole fluid.

14. The method according to claim 13, wherein the measuring the density of the downhole fluid includes using a density sensor comprising a piezoelectric material shaped as a tuning fork and having two electrodes disposed therein.

15. A non-transitory computer readable medium comprising computer executable instructions for estimating a fraction of carbon dioxide present in a fluid downhole by implementing a method comprising:

receiving a measurement of an ambient pressure of the downhole fluid performed by a pressure sensor disposed at a carrier configured to be conveyed through a borehole penetrating an earth formation;

receiving a measurement of an ambient temperature of the downhole fluid performed by a temperature sensor disposed at the carrier; and estimating the fraction of carbon dioxide in the downhole fluid by using a correlation function with the ambient pressure and the temperature as inputs.

* * * * *